US007273234B1

(12) United States Patent
Collins et al.

(10) Patent No.: US 7,273,234 B1
(45) Date of Patent: Sep. 25, 2007

(54) CARD WITH INCREASED GRIPABILITY

(75) Inventors: Richard J. Collins, Charlotte, IL (US); R. Bruce Montgomery, Jr., Charlotte, NC (US); Allen Kendle, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 1555 days.

(21) Appl. No.: 09/611,320

(22) Filed: Jul. 6, 2000

Related U.S. Application Data

(63) Continuation-in-part of application No. 09/095,752, filed on Dec. 30, 1997, now abandoned.

(51) Int. Cl.
*B42D 15/00* (2006.01)

(52) U.S. Cl. ..... 283/83; 283/86; 283/72; 283/904

(58) Field of Classification Search ..... 283/83, 283/72, 86, 904, 117
See application file for complete search history.

(56) References Cited

U.S. PATENT DOCUMENTS 3,230,650 A 1/1966 Orkin
4,079,883 A 3/1978 Calder
4,338,805 A 7/1982 Nygren
4,443,027 A * 4/1984 McNeely et al. ..... 283/83
4,628,195 A 12/1986 Baus
4,856,310 A 8/1989 Parienti
4,914,281 A 4/1990 Benton et al.
4,950,279 A * 8/1990 Chang ..... 606/189
5,061,845 A 10/1991 Pinnavaia
5,096,228 A 3/1992 Rinderknecht
5,250,341 A 10/1993 Kobayashi et al.
5,556,092 A * 9/1996 Theken ..... 273/75
5,700,037 A 12/1997 Keller
5,844,230 A * 12/1998 Lalonde ..... 283/904

FOREIGN PATENT DOCUMENTS

WO WO93/11510 6/1993

* cited by examiner

*Primary Examiner*—Willmon Fridie, Jr.
(74) *Attorney, Agent, or Firm*—Moore & Van Allen PLLC

(57) ABSTRACT

The invention disclosed herein represents a means for increasing the gripability of a credit-card-sized card. Specifically, dimples raised from, indented in, or embossed in a credit-card-sized card are arranged to from a tread on the front or back of a card. This tread allows fingers to more easily grip a credit-card-sized card for ease of handling or removal from a wallet or carrying case. Moreover, the means disclosed does not interfere with various means such as magnetic stripes commonly used to store encoded information on credit-card-sized cards.

10 Claims, 5 Drawing Sheets

CARD WITH INCREASED GRIPABILITY

CROSS-REFERENCE TO RELATED APPLICATIONS

This application is a continuation-in-part of U.S. patent application Ser. No. 09/095,752, filed Dec. 30, 1997 now abandoned, the entirety of which is incorporated herein by reference.

BACKGROUND OF THE INVENTION

This invention relates to credit cards and other types of cards typically stored in a wallet or a carrying case. More particularly, this invention relates to increasing ability of a user to grip such a card, especially when the card includes a magnetic stripe or other means of storing encoded information.

DESCRIPTION OF THE RELEVANT ART

Cards of various kinds have become ubiquitous in modern society people often carry a number of cards in their wallet or carrying case, including credit cards, ATM or bank cards, debit cards, "smart" cards, insurance cards, a driver's license, identification cards, telephone calling cards, transit cards, library cards, and card-entry hotel keys. An increasing number of consumer transactions require the use of these cards, for example as the form of payment or as identification necessary for another form of payment or admission. Quick and accurate access to individual cards is useful and desirable for both the consumer and the vendor of goods or services.

For the consumer, typically, credit cards and other types of cards are placed in a wallet or carrying case. To perform their function properly, card wallets and carrying cases are frequently equipped with sleeves or slots for holding one or more cards in an arrangement selected by the user. In order to hold cards snugly, these sleeves are often designed to provide very little space for the card. Moreover, with a limited number of separate storage sleeves in their wallet or carrying case, many people find it necessary to store two, three or more cards in a single sleeve.

The result is that the cards are often held tightly within each sleeve, and several factors may contribute to making it difficult to remove a particular desired card from the sleeve. For example, if a consumer needs to remove a card sandwiched between two other cards in a single sleeve, there may be little surface with which to grip an individual card. In addition, the surface of many cards, such as credit cards and ATM cards, is smooth, making it difficult to grip. Consumers with large fingers, or elderly consumers or others with reduced dexterity, may thus encounter special difficulties in extricating a particular card from a wallet or carrying case. Difficulty in removing a single selected card increases the time necessary for the transaction, causes stored cards to be frequently reshuffled and potentially disorganized, and increases the likelihood that cards will be dropped or lost.

Vendors also have an interest in the ease of card removal. For a vendor, an important object of a transaction is to receive the correct card from the consumer, collect the necessary information—for example by reading the encoded information on the card's magnetic stripe—and return the card promptly. A consumer's difficulty in removing a card from a wallet or carrying case may increase transaction time, which may lead in turn to longer lines and increased waiting time for other consumers, or the need for additional personnel to serve customers in a prompt manner.

Finally, card issuers such as banks and credit card companies have an interest in a card that can be selected accurately by the consumer and read accurately by electronic readers. A card issuer typically, earns revenue when a consumer uses the issuer's card. If a card cannot be properly retrieved, the consumer may choose to use a different card, thus depriving the transaction to the issuer of the card initially sought by the consumer.

The need for quick and accurate access to a card is not diminished by the presence of a magnetic stripe on the card. Typically, such magnetic stripes are placed on the back side of the card, and usually contain encoded information that electronic readers can read to perform a function or confirm identification. For example, on credit and debit cards, the magnetic stripe on the back of the card is usually encoded with specific account information such as the credit card number, the cardholder's name, the card expiration date, and a personal identification code. Interference with the operation of the magnetic stripe could render the stripe useless or could otherwise cause the card to fail.

Proper functioning of the magnetic stripe is very important. If the electronic device for reading the encoded information cannot operate properly, the vendor must enter the information manually, using a keypad, telephone or other similar device. Manually entering the encoded information adds both indirect and direct costs to the vendor. For example, the additional time necessary to enter the information manually may increase needs for register operators and decrease the vendor's ability to attend to other customer service matters. In addition, vendors are frequently charged increased transaction fees by the card issuer for a manually entered transaction.

In order to ensure interoperability between the magnetic stripe readers and cards bearing magnetic stripes, the parameters defining the magnetic stripe are governed by the International Organization for Standardization (ISO) and the International Electrotechnical Commission (IEC). The ISO/IEC 7811 provides standards for the physical characteristics of the magnetic stripe including the location of the stripe on the card, the surface profile of the stripe, and the height of the stripe above the card surface.

While less common today than magnetic stripe cards, smart cards are also gaining popularity with consumers. Smart cards contain an embedded computer chip containing digitally encoded information. The proper functioning of the embedded computer chip, like the proper functioning of the magnetic stripe, is essential for commercial transactions.

U.S. Pat. No. 5,096,228 issued to Rinderknecht, entitled "Notched I.D. Card," suggests an early approach for improving the ability of a user to grip a card. Rinderknecht teaches the use of substantial notch or hole in the card. This solution, however, has a number of short-comings. Most importantly, a notch in the card as disclosed in Rinderknecht can interfere with the proper functioning of the magnetic stripe typically found on credit cards and other cards in use today and with the proper functioning of the computer chip in smart cards.

SUMMARY OF THE INVENTION

An object of the invention is to improve the ability of a user to grip—that is, to improve gripability—of credit-card-sized cards often stored in a wallet or carrying case. A further object of the invention is to increase the gripability of credit-card-sized cards that include a magnetic stripe or other means for encoding information without interfering with the intended operability of the magnetic stripe or other means of encoding information.

Another object of the invention is to use either raised or indented dimples, or a combination of raised and indented dimples, on the front side, on the back side, or both sides of the card, to increase the gripability of the card.

The present invention, as broadly described herein, provides a credit-card-sized card with a front, a back, edges, and a means for improving the gripability of the card. In one embodiment the means for improving gripability comprises dimples arranged in a variety of locations along the top of the front side of the card. In another embodiment, the dimples are arranged near the top of the front side of the card and also on the sides of the front of the card. In yet another embodiment, dimples are arranged on the front side of the card near all four edges. In each of these preferred embodiments, the numerous dimples may be grouped in close proximity, and arranged into treads or otherwise arranged to improve the gripability of the card.

Additional objects and advantages of the invention are set forth in part in the description which follows, and in part are obvious from the description, or may be learned by practice of the invention.

BRIEF DESCRIPTION OF THE DRAWINGS

The accompanying drawings, which are incorporated in and constitute part of the specification, illustrate preferred embodiments of the invention, and together with the description, serve to explain the principles of the invention.

FIG. 3A and FIG. 3B show the location on the back of a card that is reserved for the magnetic stripe.

FIG. 5D is a partial sectional view of a card taken through the means to improve gripability where the means includes crater-type dimples, which are both raised and indented from the surface of the card.

DETAILED DESCRIPTION OF THE PREFERRED EMBODIMENTS

Figure 1:
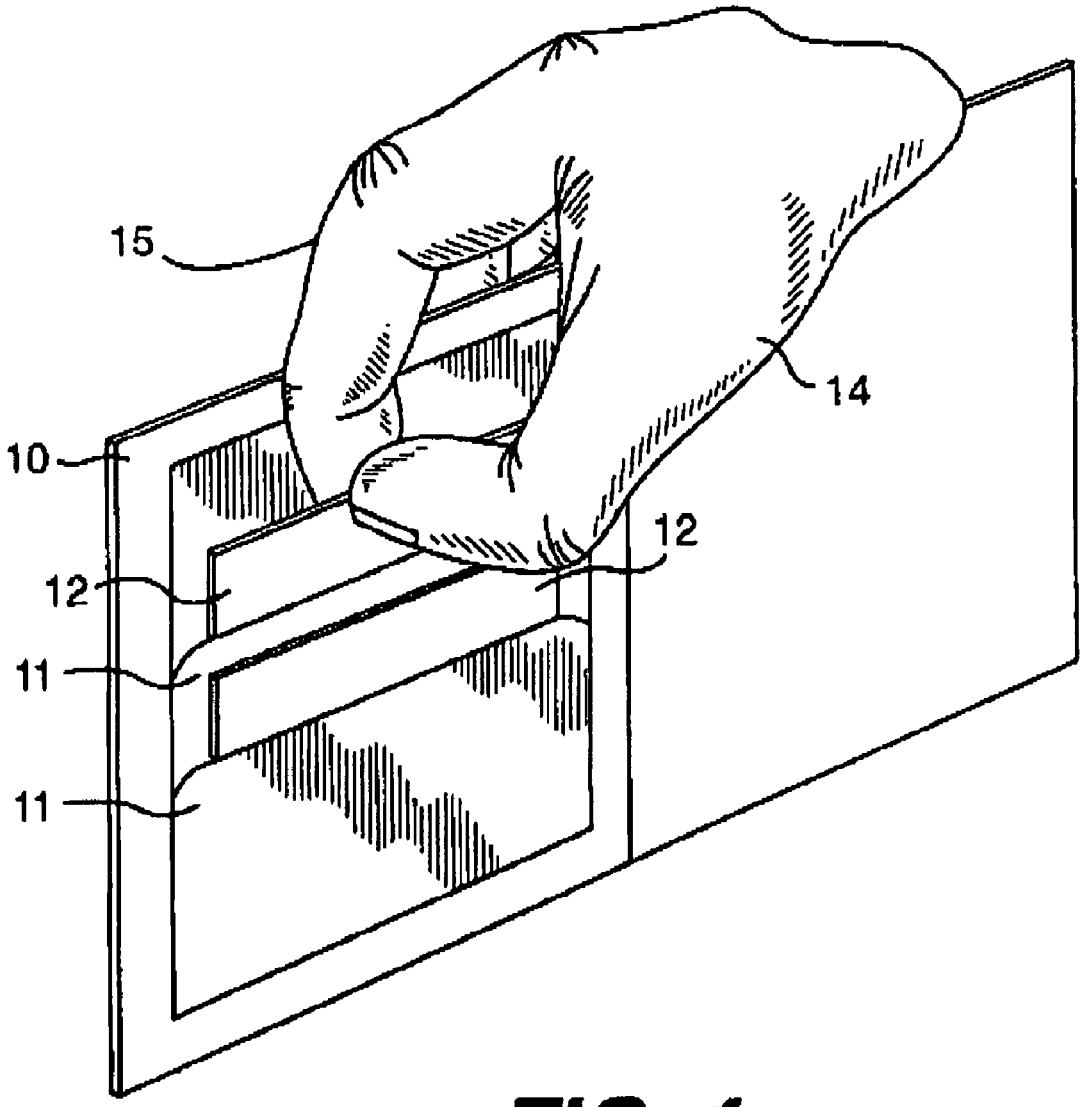
FIG. 1 is an illustration of the prior art wherein a wallet or carrying case holds a number of credit-card-sized cards.

Reference will now be made in detail to the present preferred embodiments of the invention, examples of which are illustrated in the accompanying drawings, wherein like reference numerals indicate like elements throughout the several views.

FIG. 1 illustrates the state of the prior art. Typically, a user carries numerous credit-card-sized cards 12 in a wallet 10 or carrying case (not depicted). The wallet 10 or carrying case often contains numerous sleeves 11 in which a consumer can place one or more cards 12. Because it is often necessary or desirable to carry a large number of cards 12, the cards 12 may often be tightly packed within the wallet 10 or carrying case. The wallet 10 or carrying case often has a limited number of sleeves 11, making it frequently necessary to place more than one card 12 in a single sleeve 11. This frequently packs the cards 12 tightly within the wallet 10 or carrying case.

Because the cards 12 may be packed tightly, it is often difficult to remove a specific card. Typically, it is necessary for the user to wedge her forefinger behind the card 12 while applying pressure with her thumb 14 to the front of the card 12. This wedging may cause unnecessary bending of the card which can interfere with the operation of the card 12 in a reader or other device. If the card 12 has a smooth plastic surface, for example, or if the user is wearing gloves or if her hands are slippery as other examples, withdrawing the card 12 from the wallet 10 may be even more difficult.

Figure 2:
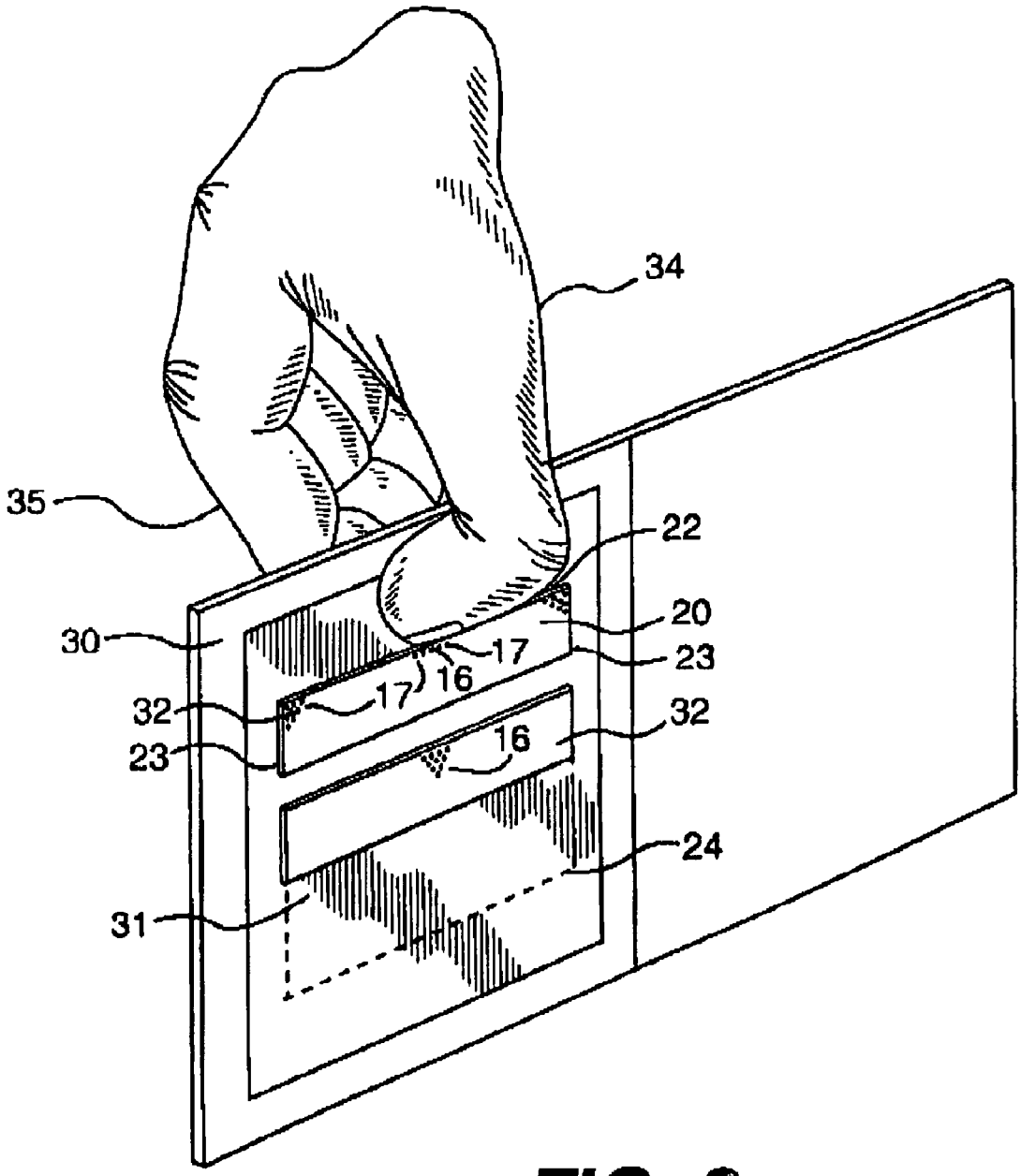
FIG. 2 is an illustration of the invention wherein each credit-card-sized card in a card wallet includes a means for improving the gripability of the card.

FIG. 2. depicts a preferred embodiment of the present invention, including a credit-card-sized card 32, including a front 20, a back (not depicted), top edge 22, side edges 23, bottom edge 24, and a means for improving the gripability of the card. While the specific embodiments illustrated are cards having magnetic stripes, e.g. credit cards, debit cards or bank cards, this is by way of example, and the invention is not limited to these types of cards.

In the preferred embodiment depicted in FIG. 2, the credit-card-sized card 32 has a length of approximately 86 mm, a width of approximately 54 mm, and a thickness of approximately I mm., in conformance with industry standards. In other embodiments, credit-card-sized card 32 has dimensions depending on the nature and use of the card, as known in the art.

In a preferred embodiment depicted in FIG. 2, the means for increasing the gripability of the card is a tread 16 made up of a plurality of individual dimples 17 arranged near top edge 22 of the card 32. The removal of a single card 32 from wallet merely requires the user to slide her thumb 34 along the face of the card 32 across the tread 16 in a direction toward the top edge 22 of card 32. This motion causes the card 32 to slide out of the sleeve 31 due to the increased friction between the thumb 34 and the card 32. As depicted, the forefinger 35 may no longer be needed for the removal of the card 32 from the sleeve 31. In an embodiment (not depicted) in which the tread 16 is located on the back of the card 32, the thumb may no longer be needed for the removal of the card 32 from the sleeve 31. In an embodiment (not depicted) in which treads 16 are located on both the front 20 and the back of the card 32, the thumb and forefinger can be used in combination.

In a preferred embodiment depicted in FIG. 2, the card 32 includes a plurality of treads 16, each located on the front 20 of the card 32 near the top edge 22. In this embodiment, the treads 16 are exposed while the card 32 is stored in sleeve 31. In another embodiment (not depicted), the treads can be located near the side edges 23 of the card; this would be useful for wallets 30 or carrying cases that store cards in an alternative orientation such that the side edge of the card is exposed stored in the wallet or carrying case. Alternate locations of the treads may depend on the expected storage arrangements of individual cards, and should be apparent to one of skill in the art from this description or from practice of the invention.

Figure 3A:
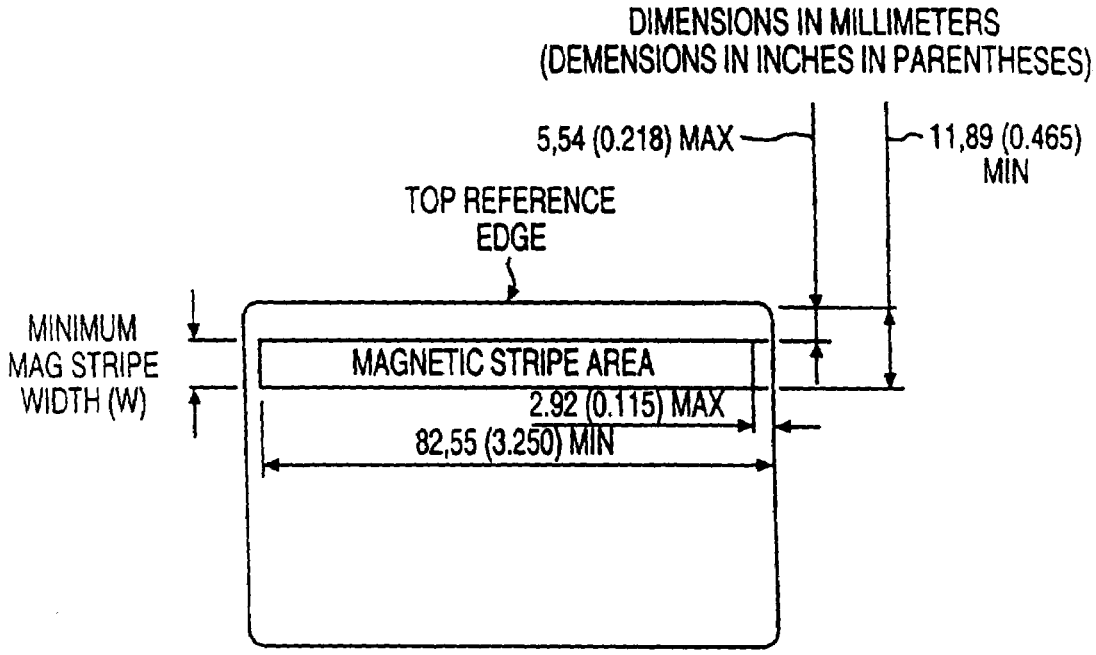
FIGS. 3A and 3B illustrate the parameters for the magnetic stripe on a credit-card-sized card; specifically.
Figure 3B:
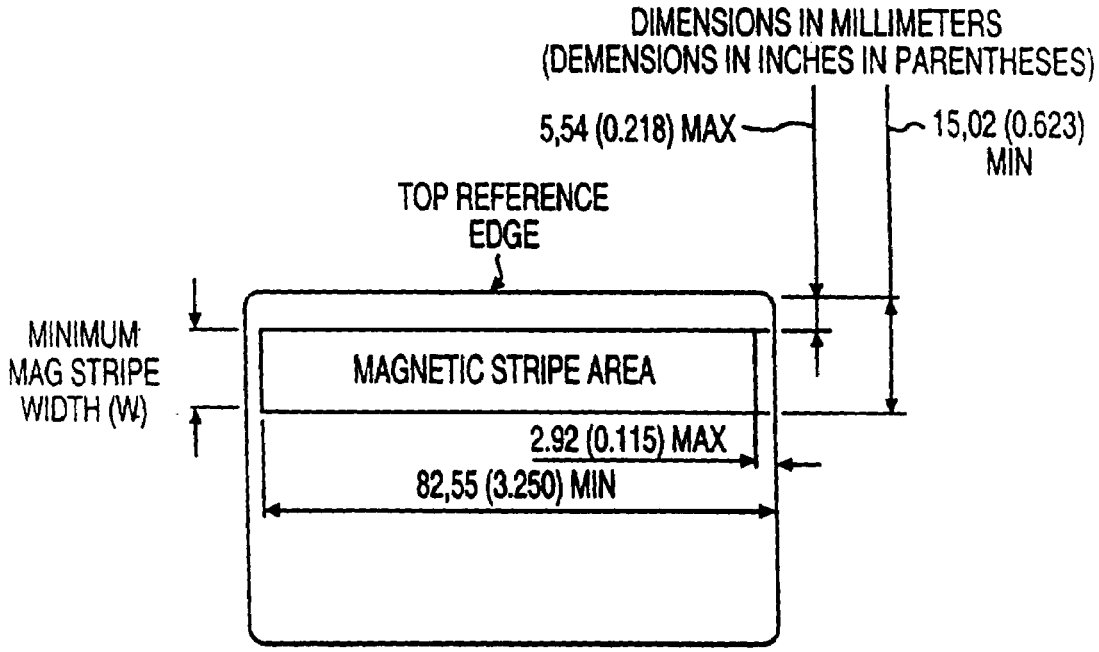

As depicted in FIG. 2, dimples 17 can be located anywhere on the card 32 but should not interfere with the readability of any information on the magnetic stripe or otherwise on the card. In a preferred embodiment, depicted in FIG. 2, the dimples 17 are located outside the area occupied by the magnetic stripe. As provided in ISO/IEC 7811, for example, the boundaries reserved for the magnetic stripe depend on how encoded information is stored on the stripe. FIG. 3A depicts a preferred location of a magnetic stripe for cards with two tracks of information. FIG. 3B, with a slightly wider magnetic stripe, shows a preferred location of the magnetic stripe 30 for cards with three tracks of information.

Figure 4A:
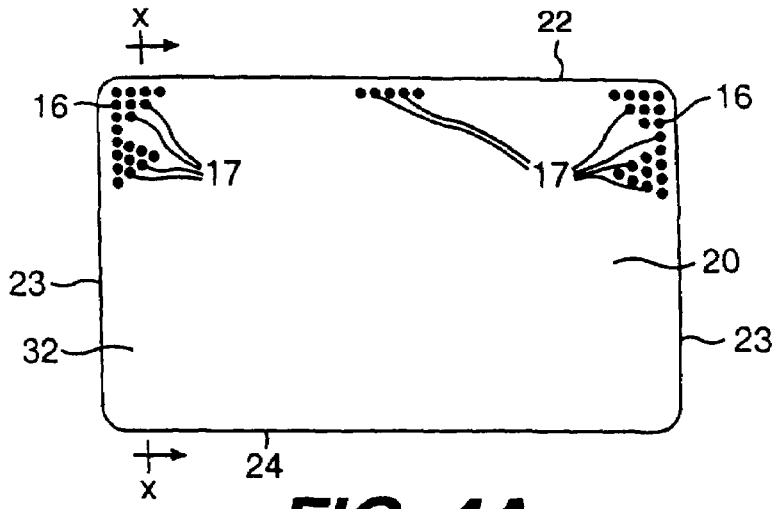
FIGS. 4A-4C illustrate three preferred embodiments of the present invention, having a means for improving the gripability of the card in various locations near the edge of the card.
Figure 4B:
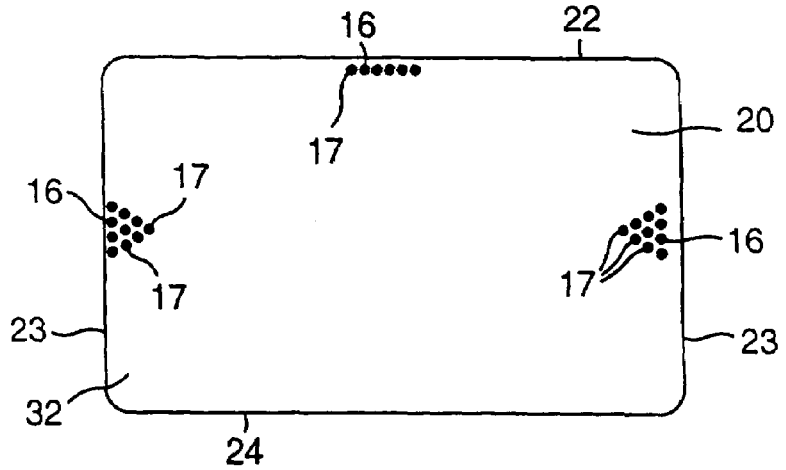
Figure 4C:
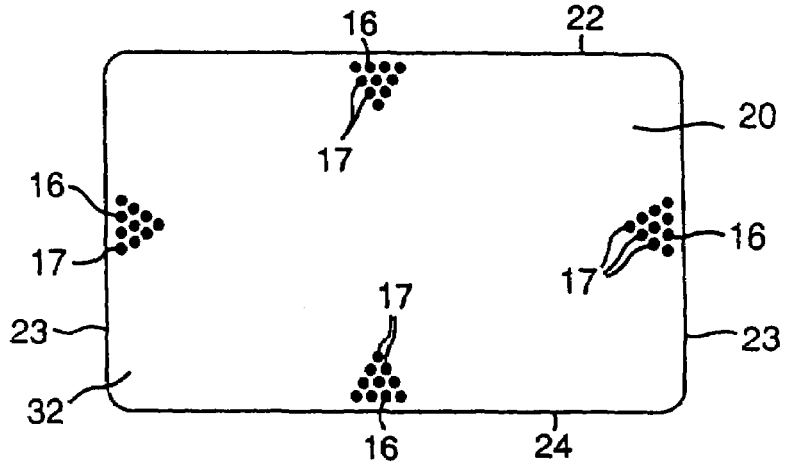

FIGS. 4A-4C depict three alternate preferred embodiments of the present invention. In each, a number of dimples 17 are arranged collectively to form a plurality of treads 16. In the preferred embodiment depicted in FIG. 4A, the dimples 17 are arranged to form treads 16 either in a triangular pattern or in a line. The dimples 17, however, can also be arranged in any number of patterns. As depicted in FIGS. 4A-4C, the treads 16 are located near an edge of the card 32, and in each preferred embodiment depicted in FIGS. 4A-4C, a tread 16 is located near the top edge 22 of the card 32. Other arrangements of dimples 17 forming treads 16 should be apparent to one of skill in the art from this description or from practice; of the invention, again depending on the intended or experienced use of the card.

Figure 5A:
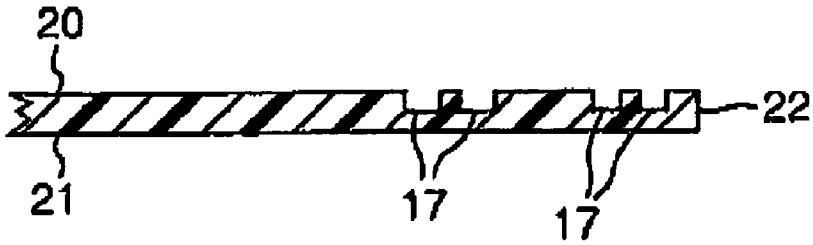
FIG. 5A is a partial sectional view of a card taken through the means to improve gripability, where the means includes dimples indented from the surface of the card.
Figure 5B:
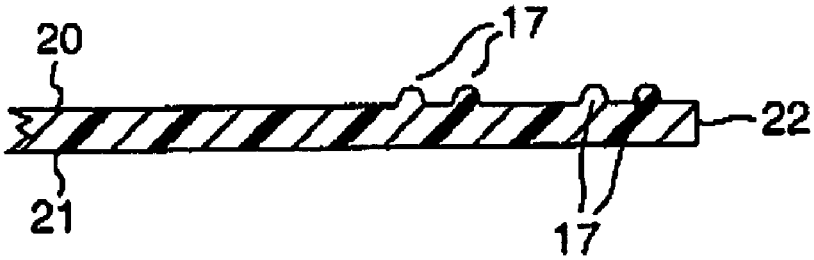
FIG. 5B is a partial sectional view of a card taken through the means to improve gripability where the means includes dimples raised from the surface of the card.
Figure 5C:
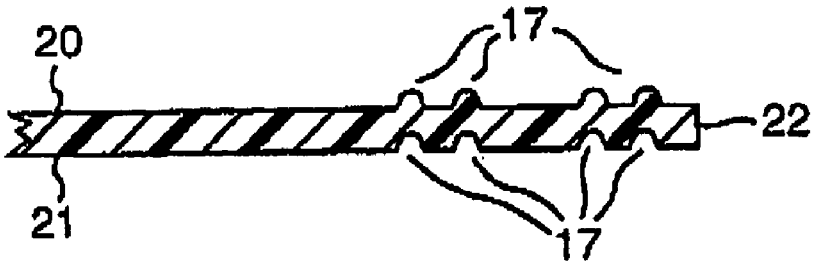
FIG. 5C is a partial sectional view of a card taken through the means to improve gripability where the means includes embossed dimples raised from the front surface of the card and indented into the back surface of the card.

FIGS. 5A-5C show sectional views of preferred embodiments of a credit-card-sized card 32 of the present invention taken along the line X-X of FIG. 4A. In FIG. 5A, the dimples 17 are indented from the front 20 of the card; in FIG. 5B the dimples 17 are raised from the front 20 of the card. In the raised dimple embodiment depicted in FIG. 5B, the height of each dimple 17 should be selected so as to not interfere with the proper operation of magnetic stripe electronic readers or other devices that require the card to be swiped by or through the reader or device. In an alternative preferred embodiment depicted in FIG. 5C, the dimples 17 are embossed such that they are raised on the front 20 of the card and indented on the back 21 of the card. In yet another alternative embodiment depicted in FIG. 5D, the dimples are created in such a manner as to create individual craters in which the lip of the crater is raised slightly above the surface of the card, while the center of the crater is slightly below the surface of the card.

Similarly, the height of dimples 17 should not exceed the height of any other embossed or raised characters or icons on the face of the card 32, so that the dimples 17 do not interfere with devices designed to imprint the raised characters or icons on receipts or other paper or similar documents. Depending on the intended or expected use of the credit-card-sized card of the present invention, the height of any dimples or other means for improving the gripability above the surface of the card should be apparent to one of skill in the art, from this description or from practice of the invention so that such dimples do not interfere with readers, imprinters or other devices designed to be used with the card.

It will be apparent to those skilled in the art that various modifications may be made to this invention and that other embodiments of the invention may be made based on this disclosure. To the extent that such other embodiments are created, it is intended that they shall fall within the protection provided by the appended claims and their equivalents.

We claim:

1. A credit-card-sized card comprising: a first face, a second face, and a tread comprising a plurality of craters disposed on one of said first and second faces, each of said plurality of craters comprising: a lip and a center, and wherein the lip of each crater is raised slightly above said one face, and the center of each crater is indented slightly into said one face.

2. A card as in claim 1, further comprising a magnetic stripe.

3. A card as in claim 2, wherein the magnetic stripe has approximate dimensions of 12 to 16 mm in width and 82 mm in length, and is located on a back of the card approximately 5 mm from and parallel to a lengthwise edge of said card.

4. A card as in claim 3, wherein the tread avoids interference with the readability of information encoded on the magnetic stripe.

5. A card as in claim 1, further comprising a computer chip embedded in said card for the storage of digital information.

6. A card as in claim 1, wherein said tread is arranged near an edge of said card.

7. A card as in claim 1, wherein said plurality of craters are arranged in at least one triangular pattern.

8. A card as in claim 6, wherein said plurality of craters are arranged in at least one triangular pattern.

9. A card as in claim 1, wherein said tread is formed on a front of said card.

10. A card as in claim 1, wherein said tread is formed on a back of said card.

* * * * *